United States Patent [19]

Dulac

[11] 4,303,198

[45] Dec. 1, 1981

[54] WOOD-BURNING BOILER

[76] Inventor: Robert R. Dulac, 111 Golder Rd., Lewiston, Me. 04240

[21] Appl. No.: 177,011

[22] Filed: Aug. 11, 1980

[51] Int. Cl.[3] ..... F25D 3/00

[52] U.S. Cl. ..... 237/56; 110/203; 110/234; 122/15; 237/8 R

[58] Field of Search ..... 126/132, 133, 344; 237/56, 59, 8 R; 110/203, 234; 122/15

[56] References Cited

U.S. PATENT DOCUMENTS 3,292,609 12/1966 Powell ..... 122/15

3,812,796 5/1974 Nagata et al. ..... 110/234

4,257,557 3/1981 Thomasma et al. ..... 126/132

*Primary Examiner*—Ronald C. Capossela

*Attorney, Agent, or Firm*—William Nitkin

[57] ABSTRACT

A wood boiler surrounded on five sides by a water jacket with a series of water-carrying pipes forming a grate adapted to hold the wood while burning and an exhaust pipe extending through the top of the water jacket beside a tankless coil for producing hot water, and a return duct provided at the junction of the exhaust pipe and the chimney adapted to return condensates to the combustion chamber.

4 Claims, 1 Drawing Figure

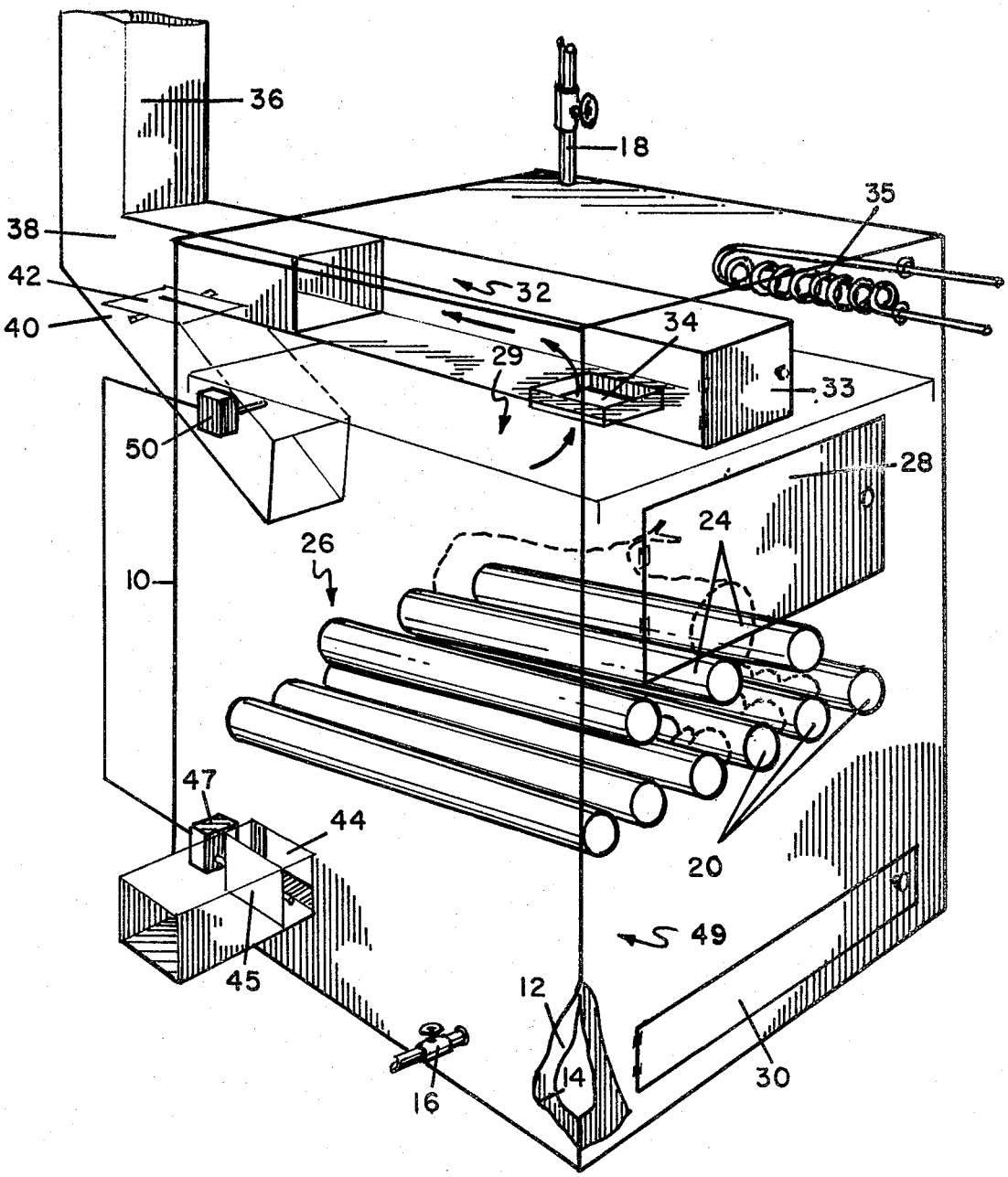
36
18
35
38
42
40
32
34
29
33
50
28
24
26
10
47
44
20
49
45
12
14
16
30

WOOD-BURNING BOILER

BACKGROUND OF THE INVENTION

1. Field of the Invention

The apparatus of this invention resides in the area of boilers for the production of heat for structures and the like and more particularly relates to an improved wood-burning boiler.

2. History of the Prior Art

Oil-burning boilers provide greater efficiency and convenience to their users when compared to wood-burning boilers, but with ever increasing costs of energy, especially of oil and gas, alternative fuel sources are being seriously looked into such as the burning of wood which is now at a comparatively lower price than other types of energy.

SUMMARY OF THE INVENTION

It is an object of this invention to provide an improved design for a wood-fueled boiler that is highly efficient and clean in its operation.

The unit incorporates a water jacket surrounding five sides of the combustion chamber, a novel water-carrying grate structure, and improved exhaust cleanout means and condensate disposal means. The basic structure of the wood-burning boiler is rectanglar having a water jacket formed on four sides and top thereof. A series of openings pass through the water jacket which will be described below. A water inlet enters the water jacket from the base of the unit, and water gravitates or is pumped between the outer and inner shells, and through the side of the water jacket and the top of the water jacket formed over the top of the combustion chamber of the boiler. Such circulation of water is adapted to carry heat away from the unit in a highly efficient manner. Within the unit are a series of water-carrying pipes forming a wood grate that extend from the front of the water jacket to the rear of the water jacket and through which the water circulates. This grate is positioned at a rearwardly sloping pitch. The wood is placed on the grate and burned. Below this grate is an area to receive fallen ashes. A wood entry door is provided in the front of the unit as well as an ash removal door at the base of the front of the unit below the water-carrying grates. An air exhaust system is incorporated in the top of the unit having an air entry means and means to carry the heated air from the front of the unit to the back where it exits up the chimney. A condensate return duct is provided disposed below the chimney having a one-way flapper mechanism to allow any condensates which condense within the chimney to come back and through the condensate return duct in the combustion chamber where the condensates will be burned. On a lower side of the unit toward the rear is an air entry vent which is controlled by a damper as will be described in further detail below. A second set of water-carrying pipes is located somewhat above the first set and will be used to increase further the transfer of heat to the water. The heat from the fire is transmitted in a highly efficient manner directly to water flowing through these water-carrying pipes and this process helps to increase the temperature and transfer of heat to the water jacket. The water passes from the water jacket through an outlet in the top of the unit to whatever heating system is utilized within the building heated by the wood boiler of this invention.

Located within an area within the wood boiler in the upper portion of the top of the water jacket to one side of the air exhaust pipe is an optional tankless coil. This coil functions to heat hot water for use at the same time the unit is producing heat for the building, thus preventing heat loss which might be caused by piping such heated water to a separate water heater and the expenditure of funds for a separately fueled water heater for the building.

BRIEF DESCRIPTION OF THE DRAWINGS

The FIGURE illustrates a perspective cutaway view of this invention.

DESCRIPTION OF THE PREFERRED EMBODIMENT(S)

The FIGURE illustrates a perspective view of the invention showing the structues which are incorporated within the improved boiler. The cutaway section discloses water jacket 10 formed by inner shell 12 and outer shell 14 around the four sides of combustion chamber 26 and water jacket area 29 at the top of the unit. Seen in this view is pipe return inlet 16 where the water enters the water jacket to surround combustion chamber 26. Water outlet 18 is provided at the top of the unit for the water to pass up, out of, and through the heating system of the building in which the unit is installed. A wood entry door 28 is provided in the front of the unit. An ash removal door 30 is provided in the front bottom of the unit. An air exhaust cleanout door 33 is provided in the top front of the the unit. Its function will be described in detail below. An air entry vent 44 is provided in the lower portion of a side of the unit to allow for air to enter into combustion chamber 26. This air entry vent 44 has a damper member 45 controlled by motor 47 which will either open it completely or close it depending on the temperature in an aquastat located elsewhere in the system. The fact that the unit is turned on or off without an intermediate stage helps prevent creosote buildup within the system. It has been found that even if the unit is off for a period of time in a dormant state, once it is turned on, it starts up rapidly and reaches a high temperature almost immediately.

Within the top of the water jacket of the unit is air exhaust pipe 32 with its air entry aperture 34 exhausting combustion chamber 26 to chimney 36. It has been found that the air entry aperture 34 is best located near the front of the unit so that the hot gases will pass from the front of the unit through air exhaust pipe 32 to the rear where they exit. Because the hot gases are in contact with air exhaust pipe 32 which extends within the water jacket for it full length, a more efficient heat transfer occurs. The hot gases pass up chimney 36 through outlet extension pipe 38. Below outlet extension pipe 38 is condensate return duct 40. A one-way flapper 42 is disposed therein. The condensate return duct 40 allows condensate from the chimney to pass down therethrough and back into the combustion chamber where the condensates will be burned. This process helps prevent a buildup or condensates within the chimney by disposing of them within the fire chamber itself. The one-way flapper prevents the combustion chamber exhaust from passing upwards through the condensate return duct, causing it to pass only through air entry aperture 34 of air exhaust pipe 32. Condensate return duct 40 when opened also allows smoke to exit through the condensate return duct when opening the wood entry door 28 acting as an alternate flue. It is also useful to open flapper 42 when starting the fire. An optional addition located within the upper portion of the water jacket to one side of air exhaust pipe 32 is tankless coil 35 in which water will enter, pass through the coil, and exit to provide heated water for the building in which the unit is used. A separate tankless coil can also be utilized instead. An air exhaust cleanout door 33 is provided in front of the unit at the end of air exhaust pipe 32 which can be opened for easy cleaning of ash, particle matter or condensates that may remain in the air exhaust pipe.

An important part of the unit is a first primary series of water-carrying pipes which form wood grate 20 which extends from the front of the water jacket to the rear of the water jacket and through which water flows. These are the pipe members upon which the logs or wood rest as they burn. This arrangement helps transfer the heat directly through the pipes to the water therein and aids in the efficiency of the unit. A second set of water-carrying pipes usually less in number than the first set of pipes may be disposed somewhat above the first set so that the coals of the logs will have pipes passing through the pile itself and provide more pipe surface area for heat transfer. The pipes are disposed at a pitch being somewhat higher in the front than in the rear for aiding in the flow of water and also helping the ash be more easily disposed of as it passes between the pipes to the ash catch area 49 which is reached from the front through ash removal door 30 when it is desired to remove the ash from the unit. It has been found that the unit works highly efficiently and transfers a significant amount of heat from the combustion chamber to the water in the grates and the water jacket surrounding it. Further the structure of the air exhaust maintains that efficiency by keeping the hot gases in a heat transference mode to the water for a longer period of time since the gases must pass from the front of the chamber to the rear of the unit within the water to reach the chimney. The condensate return duct helps keep the chimney clean of condensates by allowing them to return into the combustion chamber where they are burned.

Although the present invention has been described with reference to particular embodiments, it will be apparent to those skilled in the art that variations and modifications can be substituted therefor without departing from the principles and spirit of the invention.

I claim:

1. An improved hot water heating system wood boiler comprising:

an inner and outer shell forming a water jacket with four sides and top thereof, the thickness of the top of said water jacket being greater than the thickness of each of the sides of said water jacket;

a base affixed to said water jacket forming a closed combustion chamber;

air entry means disposed at the base of said combustion chamber;

control means to control the air entering said air entry means;

water inlet means located at the base of said water jacket disposed and adapted to have water enter into said water jacket between said inner and outer shells;

water outlet means disposed at the top of said water jacket for providing heated water to the heating system of the structure in which the unit is to be used;

a first set of water-carrying pipes forming a wood grate within said combustion chamber extending from the front of said water jacket to the rear of said water jacket at a slight pitch, being positioned higher at the front than at the rear;

a second set of water-carrying pipes having fewer pipes in number than said first set extending somewhat above said first set and at a slight angle from the front of said water jacket to the rear of said water jacket;

a wood entry door disposed through the front of said water jacket for the entry of wood into said combustion chamber;

an ash removal door disposed through the front bottom of said water jacket for the removal of ash once the wood is burned and the ash particles have fallen to an ash catch chamber formed below said first and second sets of water-carrying pipes above said base;

an air exhaust member passing through a portion of the top of said water jacket having an air entry member positioned at the front of said combustion chamber near the front of said water jacket so that the air must pass through the length of the air exhaust pipe to a chimney means;

a condensate return duct extending from below said chimney into which said air exhaust pipe is interconnected adapted to allow condensates to re-enter the combustion chamber; and openable means to prevent the exhaust from said combustion chamber from passing back up the condensate return duct and out the chimney.

2. The boiler of claim 1 further including a tankless coil water heater disposed in the upper portion of said water jacket for the heating of hot water for the structure in which the unit is to be used.

3. The boiler of claim 1 wherein said means to prevent the condensates from passing up said condensate return duct comprises a one-way flapper adapted to open only in a downward fashion for condensates to pass from said chimney down into said combustion chamber and to close when there is exhaust pressure in said combustion chamber, causing the heated air from said combustion chamber to then pass out through said air exhaust pipe.

4. The boiler of claim 3 further including:

damper means for opening and closing said air entry vent; and means to open and close said damper depending upon the temperature of the water within the heating system of the structure.

* * * * *